US005551595A

United States Patent [19]

Mertens et al.

[11] Patent Number: 5,551,595

[45] Date of Patent: Sep. 3, 1996

[54] DISPENSER PACKAGE FOR USE IN RING BINDERS

[75] Inventors: Timothy A. Mertens, Cottage Grove; Alden R. Miles, Lakeville, both of Minn.

[73] Assignee: Minnesota Mining and Manufacturing Company, St. Paul, Minn.

[21] Appl. No.: 268,923

[22] Filed: Jun. 30, 1994

[51] Int. Cl.[6] ..... A47K 10/24

[52] U.S. Cl. ..... 221/45; 206/449

[58] Field of Search ..... 221/33, 45, 56, 221/197, 63; 206/215, 39, 449

[56] References Cited

U.S. PATENT DOCUMENTS

| | | | |
|---|---|---|---|
| 4,653,666 | 3/1987 | Mertens | 221/45 |
| 4,770,320 | 9/1988 | Miles et al. | 221/33 |
| 4,781,306 | 11/1988 | Smith | 221/33 |
| 5,080,254 | 1/1992 | Feer | 221/33 |
| 5,086,946 | 2/1992 | Blackwell et al. | 221/45 |
| 5,158,205 | 10/1992 | Bodziak et al. | 221/51 |
| 5,397,117 | 3/1995 | Mertens | 221/34 |
| 5,411,168 | 5/1995 | Mertens et al. | 221/22 |

FOREIGN PATENT DOCUMENTS

3323186A1 1/1985 Germany .

OTHER PUBLICATIONS

U.S. patent application Ser. No. 08/263,601 filed Jun. 21, 1994.

*Primary Examiner*—Kenneth Noland

*Attorney, Agent, or Firm*—Gary L. Griswold; Walter N. Kirn; William L. Huebsch

[57] ABSTRACT

A thin dispenser package including a housing having a peripheral edge portion with through openings that can be mounted in a ring binder or a hook like projection that can be engaged in pocket folders, portfolios or the like. The dispenser package includes a stack of flexible sheets adhered together by layers of pressure sensitive adhesive with first and second ends of successive sheets in the stack adjacent; and the enclosure in which the stack of sheets is positioned that has a slotted top wall. The first end portion of the uppermost sheet on the stack projects through the slot. As that uppermost sheet is pulled through the slot, the first end portion of the first underlying sheet moves through the slot with the second end portion of the uppermost sheet to leave, after the uppermost sheet is fully peeled from the first portion of the first underlying sheet, the first end portion of the first underlying sheet in a position projecting through the slot.

8 Claims, 2 Drawing Sheets

DISPENSER PACKAGE FOR USE IN RING BINDERS

TECHNICAL FIELD

The present invention relates to dispenser packages for a plurality of flexible sheets each comprising a layer of pressure sensitive adhesive on a backing, which sheets have first and second ends and are adhered to each other in a stack with the first and second ends of successive sheets in the stack adjacent, and have first end portions adjacent their first ends that are not adhered to or can be easily separated from the underlying sheet in the stack to facilitate removal of the uppermost sheet in the stack.

BACKGROUND ART

Dispenser packages are known that include a plurality of flexible sheets each comprising a layer of pressure sensitive adhesive on a backing, which sheets have first and second ends and are adhered to each other in a stack with the first and second ends of successive sheets in the stack adjacent, and have first end portions adjacent their first ends that are not adhered to (or can be easily separated from) the underlying sheet in the stack to facilitate removal of the uppermost sheet in the stack.

U.S. Pat. No. 5,086,946 describes such a package including such a stack of sheets in which the layers of pressure sensitive adhesive extend over the entire backings on the sheets, and the separation of the first end portions of the sheets is afforded by the use of release means for providing a first low adhesion level along the first end portion of each of the sheets between the layer of adhesive and the surface of the adjacent sheet in the stack to which the layer of adhesive is releasably adhered, and attachment means for providing a second adhesion level along a second end portion of each of the sheets adjacent their second ends between the layer of adhesive and the adjacent sheet in the stack that provides a release force that is higher than the low release force along the first end portion.

U.S. Pat. No. 4,770,320 describes such a dispenser package including such a stack of sheets (that are commercially available from Minnesota Mining and Manufacturing Company, St Paul, Minn. under the trade designation "Post-it (T.M.) Brand Tape Flags") in which the layers of pressure sensitive adhesive extend over only a portion of the backings for the sheets. While each of the dispensing packages described in these U.S. Patents is effective, both utilize shuttling of the stack to dispense the sheets.

U.S. patent application Ser. No. 08/263,601, filed Jun. 21, 1994, the content whereof is incorporated herein by reference, describes a simple dispenser package for stacks of sheets of the types described above that does not require shuttling of the stack to dispense the sheets, thereby affording a reduced length for the dispenser package compared to dispenser packages in which the stack of sheets shuttles as sheets are dispensed. That dispenser package can include a stack of flexible sheets generally of the type described in U.S. Pat. No. 5,086,946, or generally of the type described in U.S. Pat. No. 4,770,320, each of which sheets has first and second ends and comprises a backing having a layer of pressure sensitive adhesive on a bottom surface by which the sheets are releasably adhered to each other in the stack with adjacent ends of the sheets aligned and with first and second ends of successive sheets in the stack adjacent. The sheets include either (1) release means for providing a first low adhesion level along a first end portion of each of the sheets adjacent its first end, which first adhesion level provides a low release force between the layer of adhesive and the adjacent top surface of a sheet to which the adhesive is releasably adhered, or (2) means for preventing adhesion of the first end portions of the sheets to underlying sheets in said stack; and attachment means for providing a second adhesion level along a second end portion of each of the sheets adjacent its second end between the layer of adhesive and the top surface of the adjacent sheet in the stack that provides a release force that is higher than the low release force (if any) along the first end portion and firmly adheres the sheet to the adjacent sheet in the stack while affording peeling the sheet from the stack along its second end portion. The first end portions of the sheets have lengths from the first ends toward the second ends of the sheets that are shorter than half the lengths of the sheets so that centered portions of the layers of pressure sensitive adhesive between the first end portions of successive sheets in the stack releasably adhere the sheets in surface to surface relationship in the stack. That dispenser package includes an enclosure comprising walls defining a chamber in which the stack of sheets is positioned. Those walls include (1) a bottom wall defining a bottom side of the chamber, (2) two top wall portions defining a top side of the chamber opposite the bottom side and having, (either initially or after the package is opened) spaced opposed first and second abutment surfaces extending generally parallel to ends of the bottom wall, which abutment surfaces define a wide generally central transverse slot having a length between the abutment surfaces that is about equal to or greater than the length of the centered portions of the layers of pressure sensitive adhesive; and (3) side walls between the top wall portions and the bottom wall. The stack of sheets is positioned in the chamber with the ends of the sheets generally parallel to the ends of the bottom wall, and the lowermost sheet in the stack adjacent the bottom wall. The dispenser package includes means for restricting endwise movement of the stack relative to the housing and means for restricting flexing of the second end portions of all but the uppermost sheet in the stack around an axis parallel to the ends of the sheets in the stack (which means can be provided by adhering the lowermost sheet in the stack to the bottom wall or including a stiff support sheet within the chamber adjacent the bottom wall to which the lowermost sheet in the stack is adhered); and one of the abutment surfaces is disposed with respect to the uppermost sheet in the stack so that the first end portion of that uppermost sheet can project through the slot and rest against that one abutment surface. The length of the slot between the abutment surfaces affords, as the uppermost sheet is pulled through the slot by its first end portion, peeling of successive portions of the uppermost sheet from the first underlying sheet in the stack to which the uppermost sheet is adhered, and then separation of the first end portion of the first underlying sheet from the second underlying sheet, and movement of the first end portion of the first underlying sheet through the slot with the second end portion of the uppermost sheet to leave, after the uppermost sheet is fully peeled from the first portion of the first underlying sheet, the first end portion of the first underlying sheet in a position projecting through the slot and resting against the second abutment surface and disposed in a position where it may be grasped for manual removal in a manner similar to the removal of the uppermost sheet.

U.S. Pat. No. 5,158,205 describes an inexpensive dispenser for a small stack (e.g., less than 100 sheets) of similarly sized sheets of note paper (e.g., a stack of note paper that is commercially available from Minnesota Mining and Manufacturing Company under the trade designation "Fan-folded Post-it (™) Brand Note Pad for Post-it (™) Pop-up Note Dispensers) of the type each having a narrow band of adhesive coated on its bottom surface along one edge by which the sheet is adhered to the top surface of the adjacent sheet in the stack with the sheets being stacked with the band of adhesive of adjacent sheets at alternate opposite sides of the stack. The dispenser comprises a housing closely receiving the stack, which housing includes a top wall comprising a single layer of flexible material adjacent a top surface of the stack. The top wall has spaced edge surfaces extending between flanking slits that define two opposed flap like portions of the top wall and a slot through the top wall between the flap like portions, through which slot projects an end portion of the uppermost sheet in the stack. When the uppermost sheet in the stack is withdrawn through the slot, the flap like portion adjacent the band of adhesive on the uppermost sheet will flex away from the stack to form a convex arcuate surface adjacent the stack along which the sheet being withdrawn and the end of the second uppermost sheet in the stack to which the band of adhesive is adhered can slide to thereby restrict curling of the sheets, and the flap like portion opposite the band of adhesive on the withdrawn uppermost sheet will place drag on the second uppermost sheet in the stack so that the force applied to withdraw the uppermost sheet will peal the uppermost sheet away from the end of the second uppermost sheet in the stack after it is withdrawn through the slot rather than fully withdrawing the second sheet through the slot.

DISCLOSURE OF INVENTION

The present invention provides a dispenser package that may include any of the stacks of sheets described above that is particularly adapted for use in ring binders, which can be a significant convenience for persons using the ring binders so that sheets from those stacks may be easily removed and used in conjunction with sheets in the binders or for other purposes. Also, the dispenser package may have other attachment means along one edge that is adapted for attaching the dispenser package in pocket folder, portfolios or the like.

According to the present invention there is provided a dispenser package comprising a plurality of flexible sheets of the types described above, each of which sheets has first and second spaced ends, comprises a backing having opposite major top and bottom surfaces, and has a layer of pressure sensitive adhesive on at least a second end portion of its bottom surface adjacent its second end, the sheets being releasably adhered to each other by adhesion of the layers of pressure sensitive adhesive to portions of the top surfaces of underlying sheets adjacent the first ends of the underlying sheets to form a stack with adjacent ends of the sheets aligned and with the first and second ends of successive sheets in the stack being adjacent, and having means for restricting or preventing adhesion of first end portions of the sheets adjacent the first ends to underlying sheets in the stack. The dispenser package also includes an enclosure comprising opposed top and bottom walls having opposite major surfaces, each of which opposed walls has peripheral portions and a central portion bounded by the peripheral portions. The opposite major surfaces of the top and bottom walls are adhered or otherwise attached together surface to surface along the peripheral portions so that the central portions of the walls define a chamber, and the top wall has edge surfaces between its major surfaces defining a generally central transverse slot, which edge surfaces include spaced opposed edge surfaces. The peripheral portions along one side of said chamber have spaced through openings adapted to receive the rings of a ring type binder (e.g., a 3 ring, 6 ring, or 7 ring binder or the rings of a spirally bound binder). The stack of sheets is positioned in the chamber with the bottom of the stack attached (e.g., as by a suitable adhesive) to the inner surface of the bottom wall, the ends of said sheets generally parallel to the first and second edge surfaces, the lowermost sheet in the stack adjacent the bottom wall, and the first end portion of the uppermost sheet projecting through the slot and resting against one of the opposed edge surfaces so that as the uppermost sheet is pulled through the slot by its first end portion, it will cause movement of the first end portion of the first underlying sheet through said slot with the second end portion of said uppermost sheet to leave, after said uppermost sheet is fully peeled from the first portion of the first underlying sheet, the first end portion of the first underlying sheet in a position projecting through the slot and resting against the other of the opposed edge surfaces in a position where it may be grasped for manual removal in a manner similar to the removal of the uppermost sheet.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
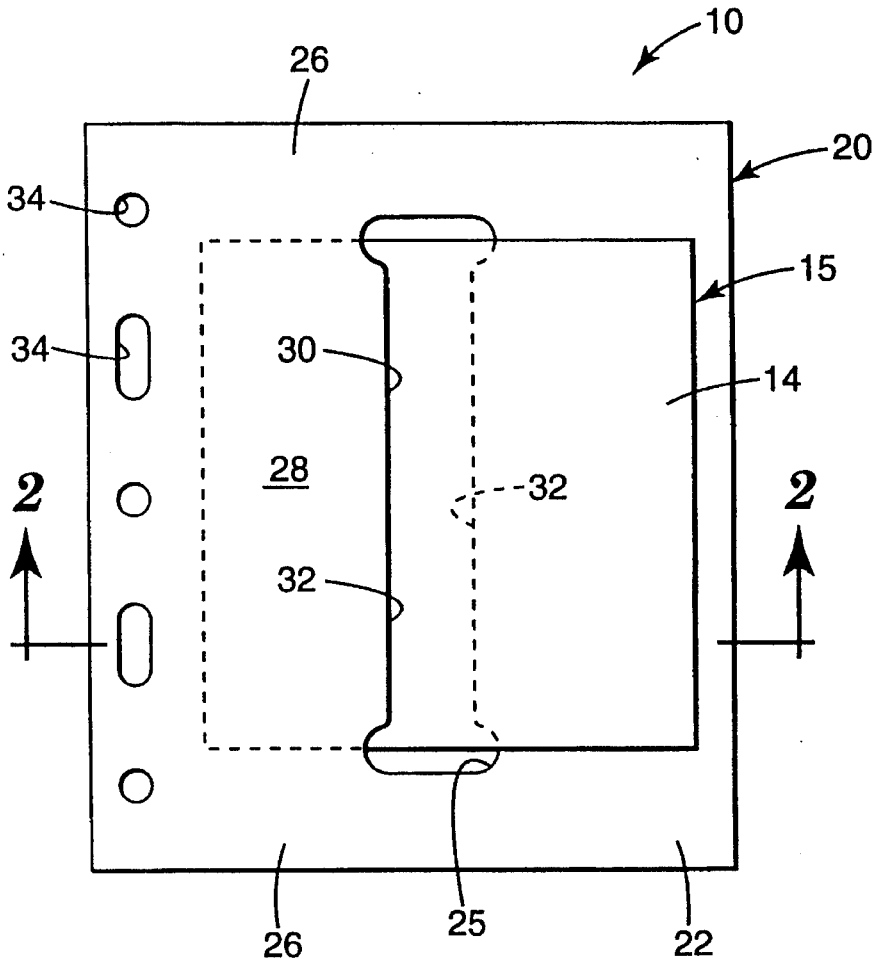
FIG. 1 is a top view of a first embodiment of a dispenser package according to the present invention.
Figure 2:
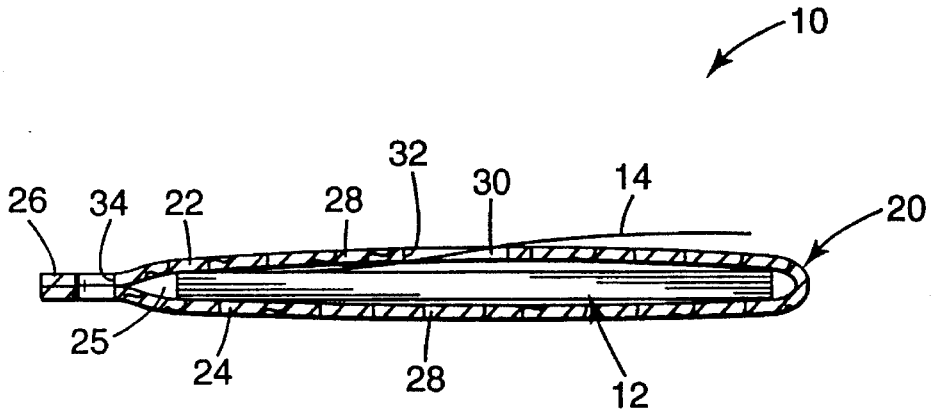
FIG. 2 is a sectional view of the dispenser package of FIG. 1 taken approximately along line 2—2 of FIG. 1.

Referring now to FIGS. 1 and 2 of the drawing, there is shown a first embodiment of a dispenser package according to the present invention generally designated by the reference numeral 10.

The dispenser package 10 comprises a stack 12 of twenty flexible paper sheets 14 of the type described in U.S. Pat. No. 4,781,306 (the content whereof is incorporated herein by reference) that are commercially available from Minnesota Mining and Manufacturing Company under the trade designation "Fan-folded Post-it (™) Brand Note Pad for Post-it (™) Pop-up Note Dispensers. Generally that stack 12 includes a plurality of the flexible sheets 14, each of which sheets 14 has first and second spaced ends and a predetermined uniform length between its first and second ends, comprises a paper backing having opposite major top and bottom surfaces, and has a layer of pressure sensitive adhesive on a second end portion of its bottom surface adjacent its second end. The sheets 14 are releasably adhered to each other by adhesion of those layers of pressure sensitive adhesive to portions of the top surfaces of underlying sheets adjacent the first ends of the underlying sheets to form the stack 12 with adjacent ends of the sheets aligned and with the first and second ends of successive sheets in the stack being adjacent. The sheets 14 have means for restricting or preventing adhesion of first end portions 15 of the sheets 14 adjacent their first ends to underlying sheets 14 in the stack 12 in that those first end portions 15 are not coated with adhesive.

The dispensing package 10 also includes an enclosure 20 comprising opposed top and bottom walls 22 and 24 (e.g., walls of 0.007 to 0.030 inch thick paperboard) folded from a single sheet along an edge and having opposite major surfaces defining a chamber 25 in which the stack 12 of sheets 14 is positioned. Each of the opposed walls 22 and 24 has rectangularly disposed peripheral portions 26 and a central portion 28 bounded by those peripheral portions 26. The opposite major surfaces of the top and bottom walls are attached together surface to surface (e.g., as buy a suitable adhesive) along the peripheral portions 26 so that the central portions 28 of the walls 22 and 24 define the chamber 25. The top wall has edge surfaces between the major surfaces of the top wall that define a generally central transverse slot 30, which edge surfaces include spaced opposed edge surfaces 32. The peripheral portions 26 along one side of the chamber 25 have spaced through circular and elongate oval openings 34 adapted to receive the rings of a ring type binder, which openings 34 as illustrated are adapted to receive the rings of 3 ring, 6 ring or 7 ring binders that are often used as personal organizers, but alternatively could be smaller and evenly spaced to receive rings of a helical ring binder. The stack 12 of sheets 14 is positioned in the chamber 25 with the lowermost sheet in the stack attached to the inner surface of the bottom wall 24, the ends of the sheets generally parallel to the opposed edge surfaces 32, the lowermost sheet 14 in the stack 12 adjacent the bottom wall 24, and the first end portion 15 of the uppermost sheet 14 projecting through the slot 30 and resting against one of the opposed edge surfaces 32. When the uppermost sheet 14 is pulled through the slot 30 by its first end portion 15, it will cause movement of the first end portion 15 of the first underlying sheet 14 through the slot 30 with the second end portion of the uppermost sheet 14 to leave, after the uppermost sheet 14 is fully peeled from the first end portion 15 of the first underlying sheet 14, the first end portion 15 of the first underlying sheet 14 in a position projecting through the slot 30 and resting against the other of the opposed edge surfaces 32 in a position where it may be grasped for manual removal in a manner similar to the removal of the uppermost sheet 14.

Figure 3:
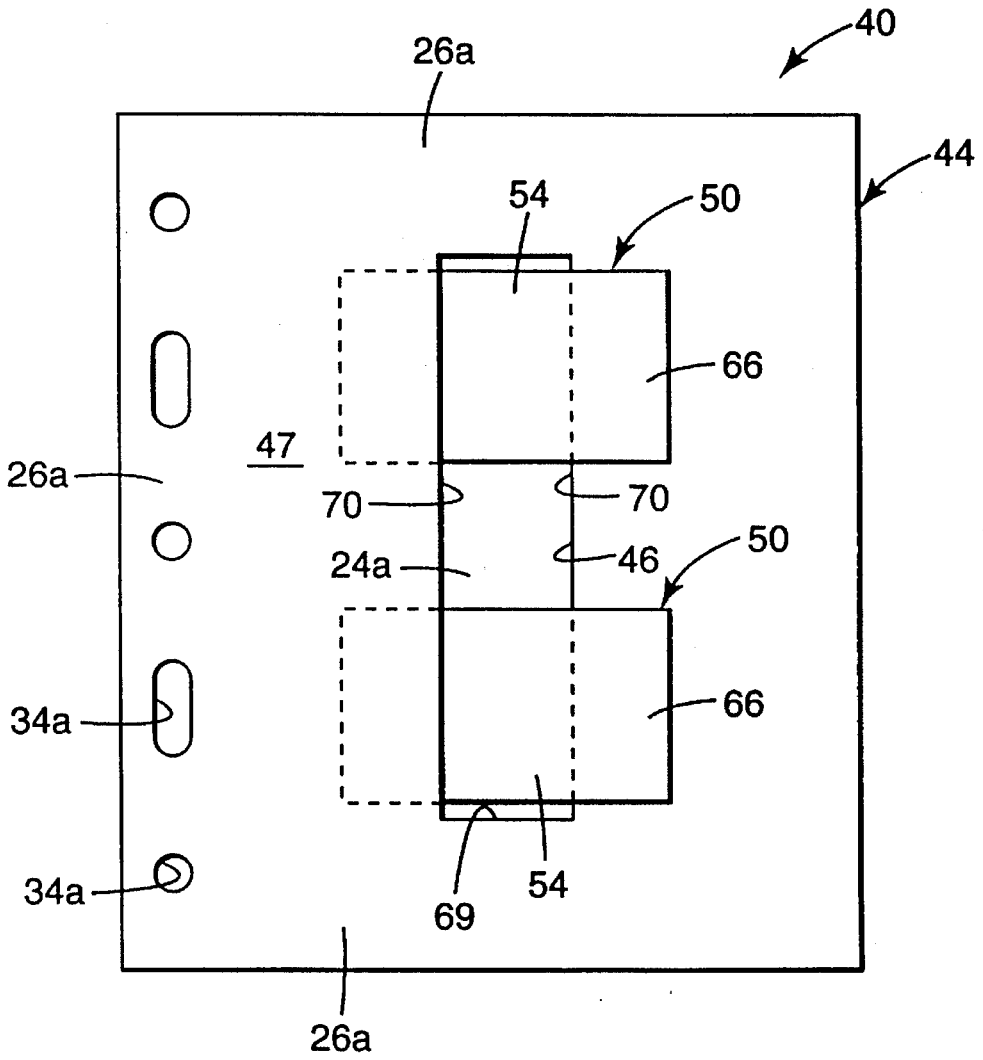
FIG. 3 is a top view of a second embodiment of a dispenser package according to the present invention.

Referring now to FIG. 3 of the drawing, there is shown a second embodiment of a dispenser package according to the present invention generally designated by the reference numeral 40. The dispenser package 40 includes an enclosure 44 that, except for the shape of a slot 46 in its top wall 47, is essentially the same as the enclosure 20 of the dispenser package 10, and has its parts identified with the same reference numerals to which has been added the suffix "a". Instead of the stack 12 of sheets 14, the dispenser package 40 includes two stacks 50 of sheets 54 of the type described in U.S. Pat. No. 4,770,320, (the content whereof is incorporated herein by reference) that are commercially available from Minnesota Mining and Manufacturing Company, St Paul, Minn. under the trade designation "Post-it (™) Brand Tape Flags". End portions 66 of the sheets on the two stacks 50 may be of different colors. Generally, each of the sheets 54 on each of the stacks 50 comprises a backing having opposite major top and bottom surfaces, first and second opposite ends, and a predetermined uniform length between its first and second ends. Each of the sheets 54 includes a layer of pressure sensitive adhesive on at least a second end portion of the bottom surface adjacent the second end of the backing, which second end portion has a length from the second end of the backing toward its first end that is longer than half the predetermined length of the backing. The sheets 54 in the stacks 50 are releasably adhered to each other by adhesion of the layers of pressure sensitive adhesive to portions of the top surfaces of underlying sheets 54 adjacent the first ends of the underlying sheets 54 to form the stack 50 with adjacent ends of the sheets 54 aligned and with the first and second ends of successive sheets 54 in the stack 50 adjacent. The sheets 54 include means for preventing adhesion of first end portions 66 of the sheets 54 adjacent their first ends to underlying sheets 54 in the stack 50, which first end portions 66 have lengths from their first ends toward their second ends that are shorter than half their predetermined lengths so that centered portions of the layers of pressure sensitive adhesive between the first end portions of successive sheets 54 in the stack 50 releasably adhere the sheets 54 in surface to surface relationship in the stack 50. In the sheets 54 of the type described in U.S. Pat. No. 4,770,320, the pressure sensitive adhesive in the layers is repositionable, and the first end portions 66 of the sheets 54 are free of adhesive on their bottom surfaces to provide that means for preventing adhesion of the first end portions 66 of the sheets 54 adjacent their first ends to an underlying sheet 54.

Alternatively, the stack 50 could be formed of sheets coated with layers of pressure sensitive adhesive along their entire lengths (e.g., such as the sheets described in U.S. Pat. No. 5,086,946, the content whereof is incorporated herein by reference) and the means for preventing adhesion of the first end portions of the sheets adjacent their first ends to an underlying sheet could be provided either (1) by coatings of release materials adjacent their first end portions on underlying sheets that prevented any adhesion of the adhesive on the first end portions of the sheets to the underlying sheets, or (2) less desirably by tabs permanently or removably adhered over the adhesive along their first end portions.

As is seen in FIG. 3, the stacks 50 of sheets 54 are positioned in a chamber 69 with the lowermost sheet in the stack attached to the inner surface of the bottom wall 24*a*, and the first end portion 66 of the uppermost sheet 54 on each of the stacks 50 projecting through the slot 46 and resting against the adjacent one of two opposed edge surfaces 70 that are part of the edge surfaces defining the slot 46. The length of the slot 46 between the opposed edge surfaces 70 is about equal to or longer that the centered portions of the layers of pressure sensitive adhesive between the first end portions of successive sheets in the stacks 50 to afford, as the uppermost sheet 54 is pulled through the slot 46 at its first end portion 66, peeling of successive portions of the uppermost sheet 54 from the first underlying sheet 54 in the stack 50 to which the uppermost sheet 54 is adhered until the uppermost sheet 54 contacts the opposite opposed edge surface 70, and then separation of the first end portion 66 of the first underlying sheet 54 from the second underlying sheet 54, movement of that first end portion 66 through the space between the stack 50 and the top wall 47 and then through the slot 50 with the second end portion of the uppermost sheet 54 to leave, after the uppermost sheet 54 is subsequently fully peeled from the first end portion 66 of the first underlying sheet 54, the first end portion 66 of the first underlying sheet 54 in a position projecting through the slot 50 and resting against the adjacent opposed edge surface 70 in a position where it too may be grasped for manual removal in a manner similar to the removal of the uppermost sheet 54. In a similar manner, subsequent underlying sheets 54 in the stack 50 may also be removed, each leaving the first end portion 66 of the next underlying sheet 54 in a position projecting from the enclosure 44 and supported against the opposite opposed edge surface 70 from that against which the sheet 54 removed was originally supported.

Figure 4:
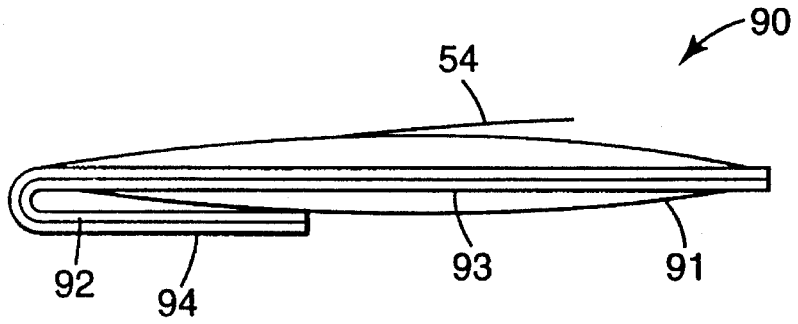
FIG. 4 is an end view of a third embodiment of a dispenser package according to the present invention.

Referring now to FIG. 4 of the drawing, there is shown a third embodiment of a dispenser package according to the present invention generally designated by the reference numeral 90. The dispenser package 90 includes an enclosure 91 that could be the same as either of the enclosures 20 or 44 and could include either of the stacks 12 or 50 of sheets 14 or 54 except that instead of the spaced through circular and elongate oval openings 34 or 34*a* adapted to receive the rings of a ring type binder, its attachment means are provided by its peripheral portions 92 along one side of its chamber being folded back along the outer surface of its bottom wall 93 to form with the bottom wall 93 a hook like structure 94 adapted to be engaged in pocket folders, portfolios, or the like.

The present invention has now been described with reference to three embodiments thereof. It will be apparent to those skilled in the art that many changes can be made in the embodiments described without departing from the scope of the present invention. For example, dispenser package could have stacks of two or more of the different types of sheets described above disposed side by side to give the user a choice of the types of sheets he might use (e.g., a stack of paper "Post-it" note sheets, two or more stacks of "Post-it" Tape flags that could have first end portions of different colors, and a stack of fully adhesive coated transparent polymeric sheets). Also, the dispenser package 10 could have adhered on the outer surface of its bottom wall one of the sheet dispenser subassemblies described in U.S. patent application No. 08/101,615 filed Aug. 3, 1993, (the content whereof is incorporated herein by reference). Thus, the scope of the present invention should not be limited to the structures and methods described in this application, but only by the structures and method described by the language of the claims and the equivalents thereof.

We claim:

1. A dispenser package comprising:

a plurality of flexible sheets, each of said sheets having first and second spaced ends and a predetermined uniform length between said first and second ends, comprising a backing having opposite major top and bottom surfaces, and having a layer of pressure sensitive adhesive on at least a second end portion of said bottom surface adjacent said second end, said sheets being releasably adhered to each other by adhesion of said layers of pressure sensitive adhesive to portions of the top surfaces of underlying sheets adjacent the first ends of the underlying sheets to form a stack with adjacent ends of said sheets aligned and with the first and second ends of successive sheets in said stack being adjacent, and having means for restricting or preventing adhesion of first end portions of said sheets adjacent said first ends to underlying sheets in said stack; and an enclosure comprising opposed top and bottom walls having opposite major surfaces, each of said opposed walls having peripheral portions and a central portion bounded by said peripheral portions, the opposite major surfaces of said top and bottom walls being attached together surface to surface along said peripheral portions so that the central portions of said walls define a chamber, and said top wall having edge surfaces between the major surfaces of said top wall defining a generally central transverse slot which edge surfaces include spaced opposed edge surfaces, and said peripheral portions along one side of said chamber having spaced through openings adapted to receive the rings of a ring type binder;

said stack of sheets being positioned in said chamber with said ends of said sheets generally parallel to said first and second edge surfaces, the lowermost sheet in said stack adjacent said bottom wall, and the first end portion of said uppermost sheet projecting through said slot and resting against one of said opposed edge surfaces so that as the uppermost sheet is pulled through said slot by said first end portion, it will cause movement of the first end portion of the first underlying sheet through said slot with the second end portion of said uppermost sheet to leave, after said uppermost sheet is fully peeled from the first portion of the first underlying sheet, the first end portion of said first underlying sheet in a position projecting through said slot and resting against the other of said opposed edge surfaces in a position where it may be grasped for manual removal in a manner similar to the removal of the uppermost sheet.

2. A dispenser package according to claim 1 wherein said stack includes no more than about 25 sheets.

3. A dispenser package according to claim 1 wherein each of said layers of pressure sensitive adhesive on each of said sheets extends only partially along said bottom surface to thereby provide said means for restricting or preventing adhesion of first end portions of said sheets adjacent said first ends to underlying sheets in said stack.

4. A dispenser package according to claim 1 wherein each of said layers of pressure sensitive adhesive on each of said sheets extends entirely along said bottom surface, and said means for preventing adhesion of first end portions of said sheets adjacent said first ends to underlying sheets in said stack comprises layers of release material on said underlaying sheets preventing adhesion thereto of said adhesive on the portions of sheets in said stack adjacent said first end portions.

5. A dispenser package comprising:

a plurality of flexible sheets, each of said sheets having first and second spaced ends and a predetermined uniform length between said first and second ends, comprising a backing having opposite major top and bottom surfaces, and having a layer of pressure sensitive adhesive on at least a second end portion of said bottom surface adjacent said second end, said sheets being releasably adhered to each other by adhesion of said layers of pressure sensitive adhesive to portions of the top surfaces of underlying sheets adjacent the first ends of the underlying sheets to form a stack with adjacent ends of said sheets aligned and with the first and second ends of successive sheets in said stack being adjacent, and having means for restricting or preventing adhesion of first end portions of said sheets adjacent said first ends to underlying sheets in said stack; and an enclosure comprising opposed top and bottom walls having opposite major surfaces, each of said opposed walls having peripheral portions and a central portion bounded by said peripheral portions, the opposite major surfaces of said top and bottom walls being attached together surface to surface along said peripheral portions so that the central portions of said walls define a chamber, and said top wall having edge surfaces between the major surfaces of said top wall defining a generally central transverse slot which edge surfaces include spaced opposed edge surfaces, and said peripheral portions along one side of said chamber being folded back along the outer surface of said bottom wall to form with said bottom wall a hook like structure adapted to be engaged in pocket folders, portfolios, or the like;

said stack of sheets being positioned in said chamber with said ends of said sheets generally parallel to said first and second edge surfaces, the lowermost sheet in said stack adjacent said bottom wall, and the first end portion of said uppermost sheet projecting through said slot and resting against one of said opposed edge surfaces so that as the uppermost sheet is pulled through said slot by said first end portion, it will cause movement of the first end portion of the first underlying sheet through said slot with the second end portion of said uppermost sheet to leave, after said uppermost sheet is fully peeled from the first portion of the first underlying sheet, the first end portion of said first underlying sheet in a position projecting through said slot and resting against the other of said opposed edge surfaces in a position where it may be grasped for manual removal in a manner similar to the removal of the uppermost sheet.

6. A dispenser package according to claim 5 wherein said stack includes no more than about 25 sheets.

7. A dispenser package according to claim 5 wherein each of said layers of pressure sensitive adhesive on each of said sheets extends only partially along said bottom surface to thereby provide said means for restricting or preventing adhesion of first end portions of said sheets adjacent said first ends to underlying sheets in said stack.

8. A dispenser package according to claim 5 wherein each of said layers of pressure sensitive adhesive on each of said sheets extends entirely along said bottom surface, and said means for preventing adhesion of first end portions of said sheets adjacent said first ends to underlying sheets in said stack comprises layers of release material on said underlaying sheets preventing adhesion thereto of said adhesive on the portions of sheets in said stack adjacent said first end portions.

* * * * *